US006793560B2

(12) United States Patent
Weigmann et al.

(10) Patent No.: US 6,793,560 B2
(45) Date of Patent: Sep. 21, 2004

(54) HONING METHOD

(75) Inventors: Uwe-Peter Weigmann, Plochingen (DE); Peter Schuele, Nuertingen (DE)

(73) Assignee: Nagel Maschinen-und Werkzeugfabrik GmbH, Nuertingen (DE)

( * ) Notice: Subject to any disclaimer, the term of this patent is extended or adjusted under 35 U.S.C. 154(b) by 0 days.

(21) Appl. No.: 10/085,311

(22) Filed: Feb. 28, 2002

(65) Prior Publication Data

US 2002/0173236 A1 Nov. 21, 2002

(30) Foreign Application Priority Data

Mar. 2, 2001 (DE) ..... 101 10 200

(51) Int. Cl.[7] ..... B24B 1/00

(52) U.S. Cl. ..... 451/51; 451/27; 451/61; 451/155; 408/158

(58) Field of Search ..... 451/51, 61, 27, 451/23, 155, 124, 157, 213; 408/158; 409/143, 200; 74/57

(56) References Cited

U.S. PATENT DOCUMENTS 4,741,129 A * 5/1988 Blake ..... 451/51
5,085,014 A * 2/1992 Sandhof ..... 451/51
5,285,598 A * 2/1994 Arita et al. ..... 451/41
5,464,364 A * 11/1995 Roitner ..... 451/194
5,482,498 A * 1/1996 Higashikawa ..... 451/61
5,630,953 A 5/1997 Klink
5,655,955 A * 8/1997 Nagel et al. ..... 451/124
5,681,210 A * 10/1997 Lin et al. ..... 451/157
5,800,252 A * 9/1998 Hyatt ..... 451/61
6,012,973 A 1/2000 Nagel

FOREIGN PATENT DOCUMENTS

DE 37 35 266 A1 4/1989
DE 42 26 335 A1 2/1994
DE 196 46 144 A1 5/1998

OTHER PUBLICATIONS

Kopp, O.: Verbesserung der Bohrungsqualitat durch Hochfrequenz–Honen, IDR 3/95, S 122–125.
German Search Report from the German Patent Office, Aug. 14, 2001.
German Search Report; May 30, 2003.

* cited by examiner

*Primary Examiner*—Joseph J. Hail
*Assistant Examiner*—Anthony Ojini
(74) *Attorney, Agent, or Firm*—Quarles & Brady LLP

(57) ABSTRACT

A honing method proposes that using an arbor honing tool a remachining be carried out using the same tool either simultaneously or following onto arbor honing, in which the ratio of the stroke speed to the rotational speed of the tool is significantly increased. This leads to a cross-structure of the honing tracks allowing a better oil holding capacity.

9 Claims, 2 Drawing Sheets

HONING METHOD

BACKGROUND OF THE INVENTION

It is known to machine bores with an extremely high accuracy of size using arbor or mandrel honing. Examples are the machining of very small bores for car injection systems, the machining of bores in hydraulic components and the machining of the large and small offices in connecting rods.

In the case of arbor honing the honing tool set to the final diameter is moved at high rotation speed, but low stroke speed at least once and at the most three times through the bore. As a result of the high circumferential speed of the honing tool compared with the stroke speed, the honing angle during arbor honing is very small.

The problem of the invention is to further develop a honing method, whilst retaining the advantages obtained by arbor honing, with regards to a tribologically favourable surface topography.

SUMMARY OF THE INVENTION

Whereas during normal arbor honing using an arbor honing tool, the bore is only slowly traversed with a high rotational speed, the invention proposes that the arbor honing tool be at least partly used in a manner not conventional in the case of arbor honing. With a small allowance for the bore to be machined, e.g. the first stroke with the arbor honing tool can be run through with an increased stroke speed to rotational speed ratio, i.e. in other words very rapidly.

If said allowance is not as small, e.g. the first stroke, i.e. the first passage through the bore can take place at the normal speed and subsequently the tool can be rapidly retracted. Under the indicated conditions, this can also lead to the production of a cross-structure.

However, according to a further development, the bore is initially machined in the conventional manner with a stroke and a return stroke and only then is the arbor honing tool used in the unconventional manner.

Thus, the bore to be machined is machined in the same way as hitherto. Use is made of an arbor honing tool, which is moved through the bore in at least one stroke and a return stroke at a high rotational speed, but low stroke speed. Subsequently either the circumferential speed is modified or the stroke speed increased. Then, using the same tool, the bore is machined again, but now as a result of the higher stroke speed compared with the rotational speed, there is a larger angle of the honing tracks. On retraction it can be ensured that a cross-structure is obtained, which then leads to the desired, improved tribological characteristics.

As a result of the characteristics of an arbor honing tool, which undergoes stress relief, the possibility arises during the return stroke that the abrasion is deeper than the honing tracks of the forward stroke. In certain circumstances this can lead to a risk of no cross-structure being formed. In order to obviate this risk in all cases, according to a further development of the invention the tool is reset prior to the remachining return stroke and is consequently stress-relieved. This resetting or stress relief can take place to such an extent that the honing tracks occurring during the return stroke have the same depth as those formed during the forward stroke.

However, it is also possible and is proposed by the invention, to perform remachining with several and in particular rapid strokes, so that as a result of the plurality of strokes there are cross-structures having the same depth.

A further infeeding of the tool is possible, so as to reliably cover the previously formed tracks.

It is also possible during the downward stroke to make the abrasion so small that in the case of a fixed set tool during the upward stroke not all the tracks of the downward stroke are abraded.

According to a further development of the invention, following onto remachining a further remachining takes place, in which the peaks of the surface structure are smoothed. This constitutes a type of plateau machining in order to be able to produce a specific support structure.

According to the invention, the same tool as for the preceding remachining can be used for said smoothing.

However, it is also possible and is proposed by the invention that the smoothing of the peaks can take place with the aid of another tool by means of arbor honing or normal honing.

BRIEF DESCRIPTION OF THE DRAWINGS

Further features, details and advantages of the invention can be gathered from the following description of a preferred embodiment thereof, the claims, whose wording is by reference made into part of the content of the description, and the attached drawings, wherein show:

DETAILED DESCRIPTION

Figure 1:
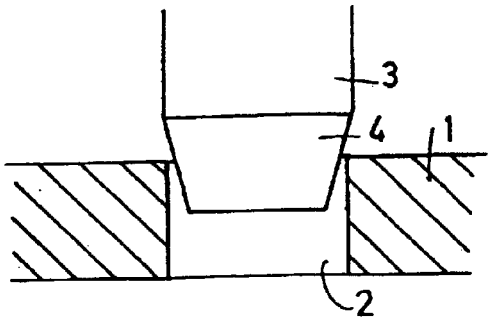
FIG. 1 A schematic view of the cross-section through a bore prior to the start of the honing proposed by the invention.
Figure 2:
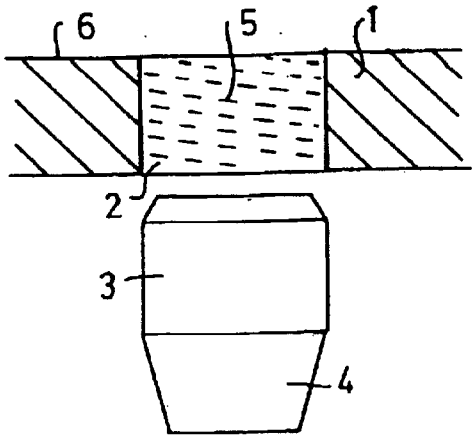
FIG. 2 A schematic view of the bore after the first stroke.

FIG. 1 diagrammatically shows the cross-section through a work-piece 1 with the bore 2 contained therein. The bore 2 has resulted from a preceding machining step and has been brought to a particular size by grinding, turning or some other machining method. The structure of the bore 2 is now to be smoothed and it is to be brought to its finished size. For this purpose a honing tool 3 is used, which is in fact a mandrel or arbor honing tool. This tool 3 contains a front, slightly conical cutting zone 4, which is shown in highly exaggerated form in the diagrammatic drawing. The tool 3 is moved at high rotational speed and low travel or stroke speed through the bore 2, so that there is an abrasion of the wall of the bore 2, i.e. the surface. The diameter of the bore increases and following the passage of the tool 3 has a surface structure with honing tracks 5. The state after the first passage of the tool 3 through the bore 2 is shown in FIG. 2. The honing tracks 5 are almost parallel to the surface 6 of the workpiece 1 or expressed differently almost perpendicular to the rotation axis of the honing tool 3. This angle differing only slightly from zero results from the high rotational speed of the tool compared with the stroke speed.

Figure 3:
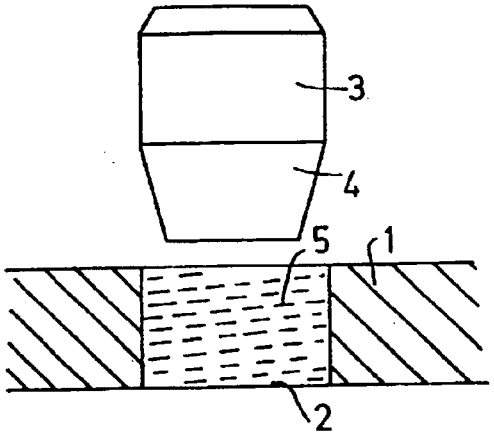
FIG. 3 A schematic view of the bore after the first return stroke.

Following the first passage through the bore 2, the tool 3 is retracted again, so that it assumes the position shown in FIG. 3. During retraction new honing tracks 5 are produced, which are once again very shallow as a result of the kinematics described. However, they now have a different orientation, because the honing tracks obtained during retraction in the example shown are deeper than the previously produced honing tracks. As a result only the honing tracks produced during the return stroke remain visible. Up to this point the honing method corresponds to a conventional arbor honing method.

Figure 4:
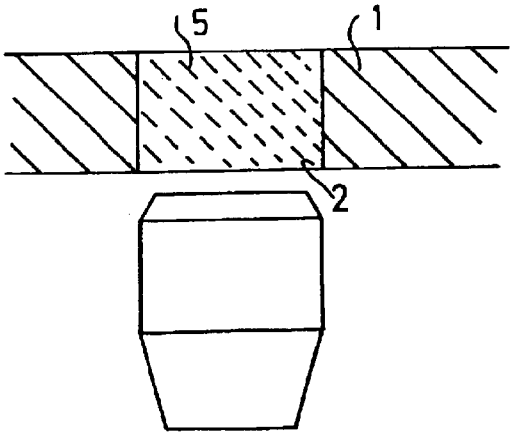
FIG. 4 A schematic view of the bore after the first remachining stroke.
Figure 5:
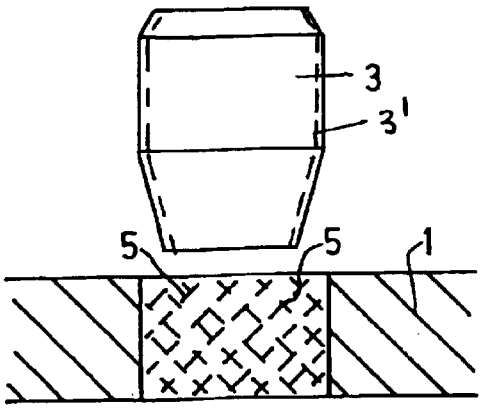
FIG. 5 A schematic view of the bore at the end of remachining.
Figure 6:
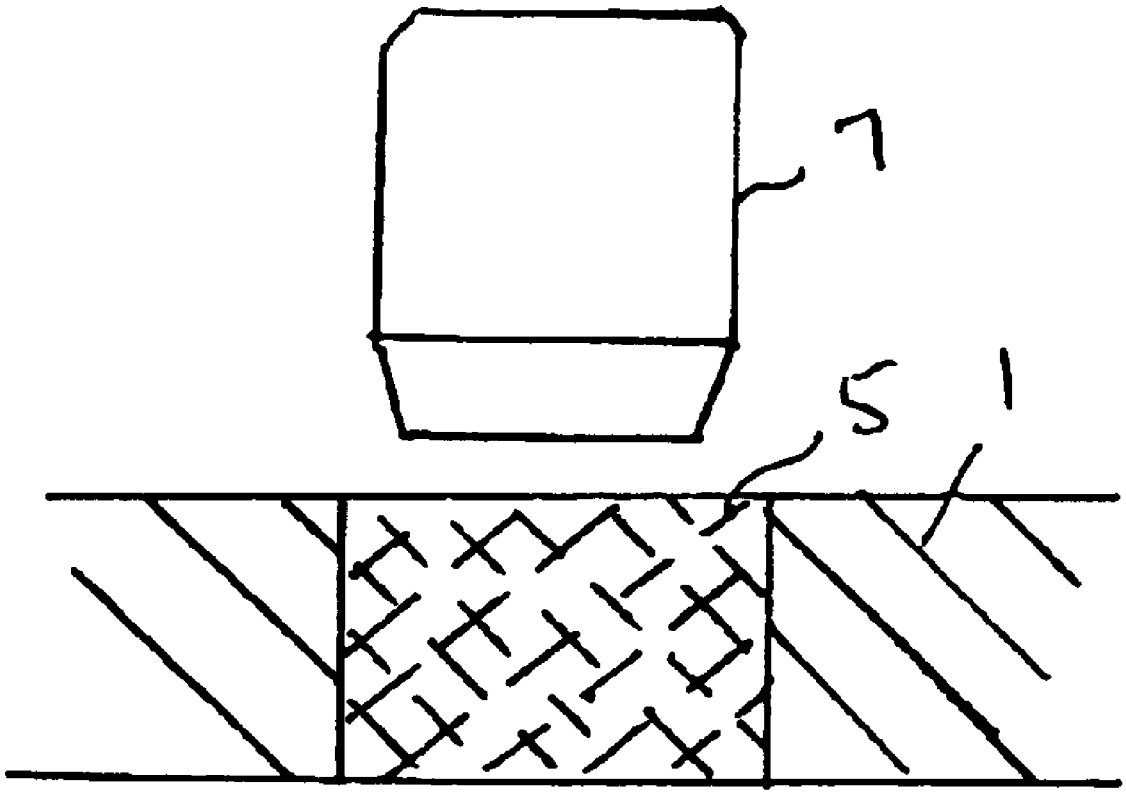
FIG. 6 A schematic view of the bore for machining with a different tool.

Now in a following re-machining process the speed of the honing tool 3 is reduced and/or its stroke speed increased. After the first re-machining stroke, the honing tracks 5 shown in FIG. 4 are obtained, and which are now disposed at a much larger angle. The angle corresponds to the angle during a conventional honing method, which functions with numerous strokes. In order to produce this structure of the honing tracks a single stroke is not sufficient, because the abrasion of the material in the preceding operation has already taken place by arbor honing. The tool 3 must now be retracted again through the bore 2. As a result of a small diameter difference between the tool and the workpiece, the abrasive grains here only have a limited penetration depth. The tracks of the preceding downward stroke are retained. The small diameter difference can, in certain circumstances, be brought about in that the tool is somewhat relieved, so that its external diameter is slightly reduced to profile 3' shown in FIG. 5. This makes it possible for the honing tracks occurring during retraction to have the same depth as the honing tracks occurring during the forward stroke and as shown in FIG. 4. Thus, a structure of the honing tracks is obtained in the manner shown in FIG. 5 after retracting the honing tool. Peaks may be formed in the surface structure as result of the re-machining operation. These peaks can be reduced or flattened by using the same tool or a different tool 7 as shown in FIG. 6.

The invention combines the advantages of arbor honing with the advantages of normal honing. The advantages of arbor honing, such as a high cylinder size accuracy, low tool costs, low machine costs and limited machining and subsidiary times can be combined with a tribologically suitable surface topography, as can be achieved using normal honing.

What is claimed is:

1. Method for machining a surface of a bore having a central axis which is also an axis of rotation for a honing tool, the method comprising:

machining the bore with a honing tool through a first forward stroke and a first return stroke of the first tool, at a relatively lower axial speed and a relatively higher rotational speed such that machining tracks resulting from the machining are within five degrees of perpendicular to a central axis of the bore; and machining the bore with the honing tool through a second forward stroke and a second return stroke in which the axial speed is increased and the rotational speed is decreased, such that crosscut tracks are produced at a greater angle from perpendicular than the machining tracks from the first forward stroke and first return stroke; and wherein said crosscut tracks are made to a substantially same depth during the second forward stroke and the second return stroke.

2. Method according to claim 1, wherein after retracting the tool from the bore on the second return stroke, the ratio of the stroke speed to the rotational speed of the tool is increased and the bore is re-machined with at least one more forward stroke and one more return stroke.

3. Method according to claim 1, wherein, prior to the re-machining return stroke, the tool is reset to a smaller size.

4. Method according to claim 1, wherein during re-machining a plurality of forward and return strokes are performed.

5. Method according to claim 4, wherein, before or during re-machining, there is a honing tool infeed.

6. Method according to claim 1, wherein, following the re-machining in which peaks are formed in the surface structure, the peaks of the surface structure are smoothed.

7. Method according to claim 6, wherein the smoothing of the peaks is performed with the tool used in the re-machining.

8. Method according to claim 6, wherein the smoothing of the peaks of the surface structure is performed with a different tool than the tool used in the re-machining.

9. Method according to claim 1, wherein arbor honing comprises a maximum of three strokes and three return strokes.

* * * * *